US005474212A

United States Patent [19]

Ichikawa et al.

[11] Patent Number: 5,474,212

[45] Date of Patent: Dec. 12, 1995

[54] LIQUID-PUMPING CONTAINER

[75] Inventors: Toru Ichikawa, Misato; Tomio Tahara, Tokyo, both of Japan

[73] Assignees: Hosokawa Yoko Co., Ltd.; Kamaya Kagaku Kogyo/Co., Ltd., Tokyo, Japan

[21] Appl. No.: 257,713

[22] Filed: Jun. 10, 1994

[30] Foreign Application Priority Data

Feb. 3, 1994 [JP] Japan ..... 6-011974

[51] Int. Cl.[6] ..... B67D 5/40

[52] U.S. Cl. ..... 222/105; 222/383.1

[58] Field of Search ..... 222/131, 183, 222/94, 382, 325, 383.1, 105

[56] References Cited

U.S. PATENT DOCUMENTS

| | | | |
|---|---|---|---|
| 4,040,959 | 8/1977 | Berman et al. | 222/94 |
| 4,138,036 | 2/1979 | Bond | 222/105 |
| 5,156,299 | 10/1992 | De Caluwe et al. | 222/383 |
| 5,263,611 | 11/1993 | Trippen | 222/105 |

FOREIGN PATENT DOCUMENTS

| | | | |
|---|---|---|---|
| 1083534 | 8/1980 | Canada | 222/183 |
| 2267428A | 12/1993 | United Kingdom . | |

*Primary Examiner*—Andres Kashnikow
*Assistant Examiner*—Philippe Derakshani
*Attorney, Agent, or Firm*—Kane, Dalsimer, Sullivan, Kurucz, Levy, Eisele and Richard

[57] ABSTRACT

The liquid-pumping container according to this invention comprises: a container consisting of a flexible bag for containing a liquid substance and an outlet block positioned at the top of the bag and provided with an outlet hole for outlet of the liquid substance, a cover block mounting portion, and a box fixing portion; a cover block which is liquid-tightly mounted on the cover block mounting portion of the outlet block; a pump mechanism provided on the cover block for pumping out the liquid substance from the bag; and a box consisting of a pair of box components which are connected to each other through hinge sections for containing the bag by fixing the outlet block on a support block of the box when the box components are closed. The liquid-pumping container has a structure which simplifies the replacement procedure of the bag containing the liquid substance and reduces the cost of manufacturing.

20 Claims, 4 Drawing Sheets

LIQUID-PUMPING CONTAINER

BACKGROUND OF INVENTION

1. Field of the Invention

The present invention relates to a liquid-pumping container comprising a flexible bag filled with a liquid substance and a box-type container having a certain rigidity for holding the flexible bag, wherein the liquid substance can be pumped out by a pump mechanism and the bag alone can be disposed of after the liquid substance is used up.

2. Background Art

Containers molded as unitary objects from polyethylene and polypropylene, or which are made of glass, are known for containing shampoo, drinking water, and the like.

Recently, however, so-called refill-type containers are in use. In these containers, a liquid substance is filled in a flexible bag which is replaceably placed in a box having a certain rigidity, and a pump mechanism is mounted on the bag to pump out the liquid substance.

Such a liquid-pumping container has been proposed previously by the same applicant (see FIG. 4 and FIG. 5).

The liquid-pumping container 21 illustrated in FIG. 4 and FIG. 5 comprises a bag 22 filled with a liquid substance and having an outlet block at the top thereof, a pump mechanism 23 for pumping out the liquid substance having a cover block to be mounted on the outlet block, and a box 25 consisting of a pair of box components 24 for containing the bag 22 by fixing said outlet block. An upper wall 24*a* of the box 25 is provided with a cover wall 26 extending upward for covering the cover block of the pump mechanism 23 and a stop shelf portion 27 extending downward for fixing and supporting the outlet block (see FIG. 5). A front wall 24*b* of each of the box components 24 is provided with a lock member which is in contact with each other when the box components are closed. A lock member clamp is slidably fixed on one of the lock members so as to clamp the lock members 28 when the box components 24 are closed.

In the above-mentioned conventional liquid-pumping container 21, the stop shelf portion 27 for fixing and supporting the outlet block of the bag 22 extends downward from the upper wall 24*a* of the box components 24. Consequently, a dead space is created in the box 25 between the upper wall 24*a* of the box components and the top end of the bag 22 when the outlet block is fixed on the stop shelf portion 27. Moreover, when the bag has become empty and is to be replaced with a new one filled with the liquid substance, it is necessary to manually hold the flexible bag 22 filled with the liquid substance for mounting the pump mechanism 23. During the replacement, the fluid substance may spill out of the bag. It is not easy to mount the pump mechanism while holding the flexible bag. Furthermore, the lock member clamp 29 should be prepared separately, which increases not only the number of assembly steps but also the manufacturing cost.

SUMMARY OF THE INVENTION

An object of this invention is to provide, at a reasonable cost, a liquid-pumping container which facilitates simple assembly and simple replacement of a disposable inner container filled with a liquid substance.

The liquid-pumping container according to this invention is characterized by comprising:

a container comprising of a bag for containing a liquid substance and an outlet block provided at the top thereof, the outlet block having an outlet hole for the liquid substance, a cover block-mounting portion, and a box-fixing portion;

a cover block to be liquid-tightly mounted on the cover-mounting portion of the outlet block;

a pump mechanism provided on the cover block for pumping the liquid substance out of the bag; and a box consisting of a pair of box components connected through hinge sections having a support portion for supporting the outlet block in a predetermined position by fixing the box-fixing portion of the outlet block so as to contain the bag inside when the box components are closed.

When assembling the liquid-pumping container, the box components are opened by rotating the components around the hinge sections and the cover block having the pump mechanism is mounted on the cover block mounting portion of the outlet block provided on the top of the bag. The bag is placed in the box components by fixing the box fixing portion of the outlet block on the support block of the box and the box components are closed. Thus, the liquid substance can be pumped out of the bag by operating the pump mechanism. When the liquid substance is used up, the box is opened and the bag is replaced with a new bag filled with the liquid substance.

As has been described above, the replacement of the bag filled with the liquid substance is significantly simplifed. Assembling of the entire liquid-pumping container can also be performed smoothly. Such a simple structure of the liquid-pumping container also contributes to the low manufacturing cost thereof.

DESCRIPTION OF THE PREFERRED EMBODIMENT

Hereinafter, an embodiment of the present invention will be described in detail with reference referring to the attached drawing.

Figure 1:
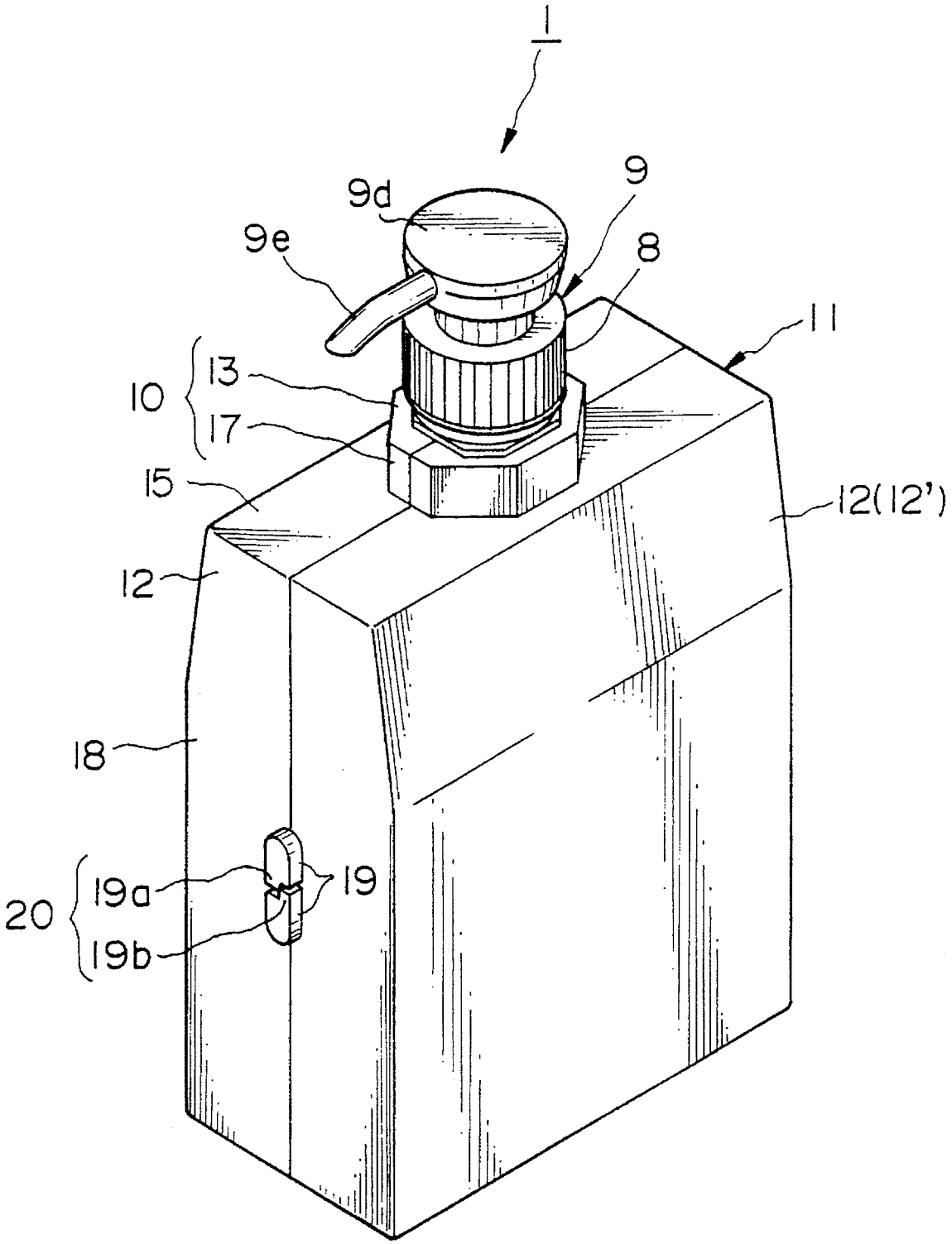
FIG. 1 is an external perspective view illustrative of a liquid-pumping container according to an embodiment of this invention.
Figure 2:
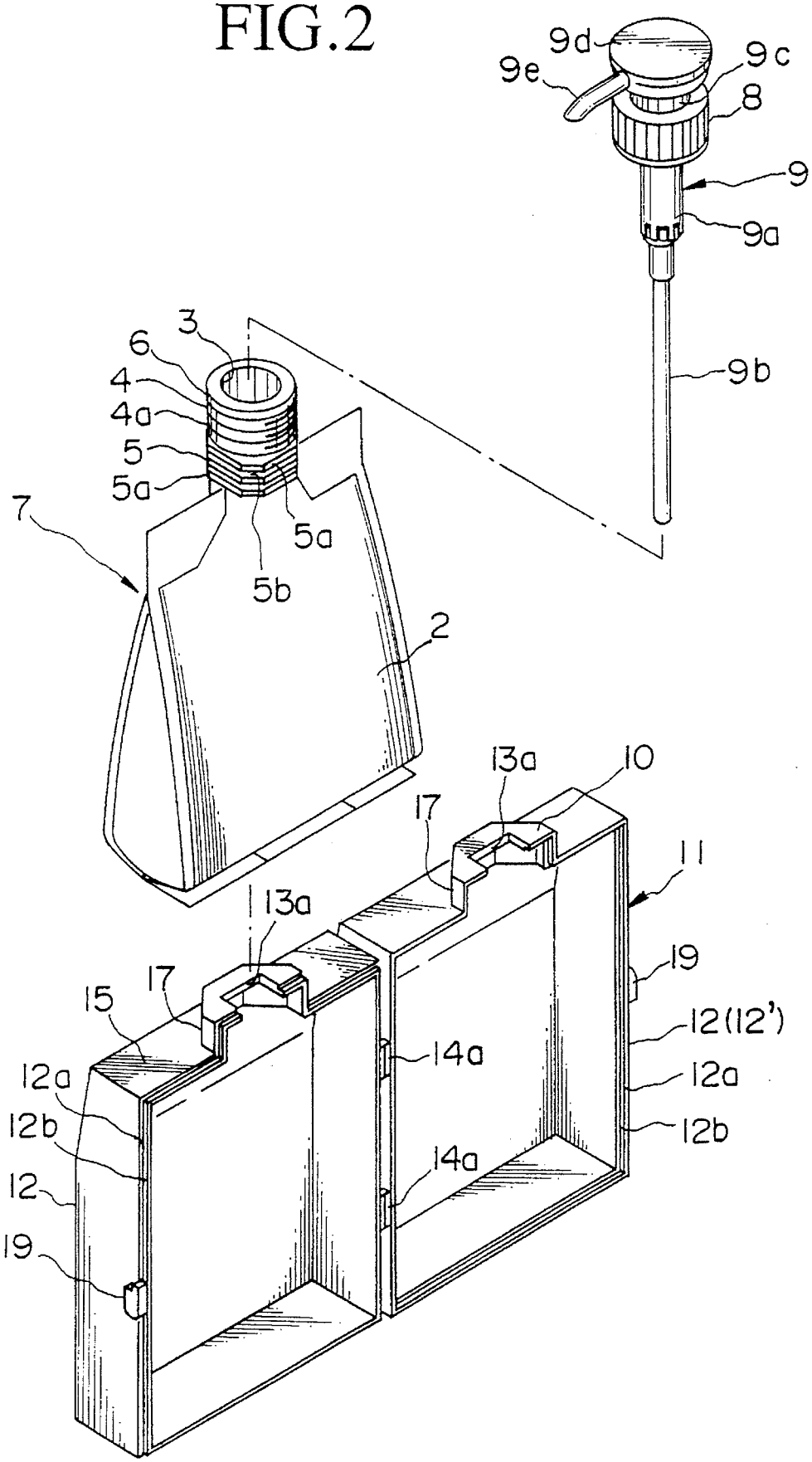
FIG. 2 is a perspective view illustrative of components of the above-mentioned embodiment.
Figure 3:
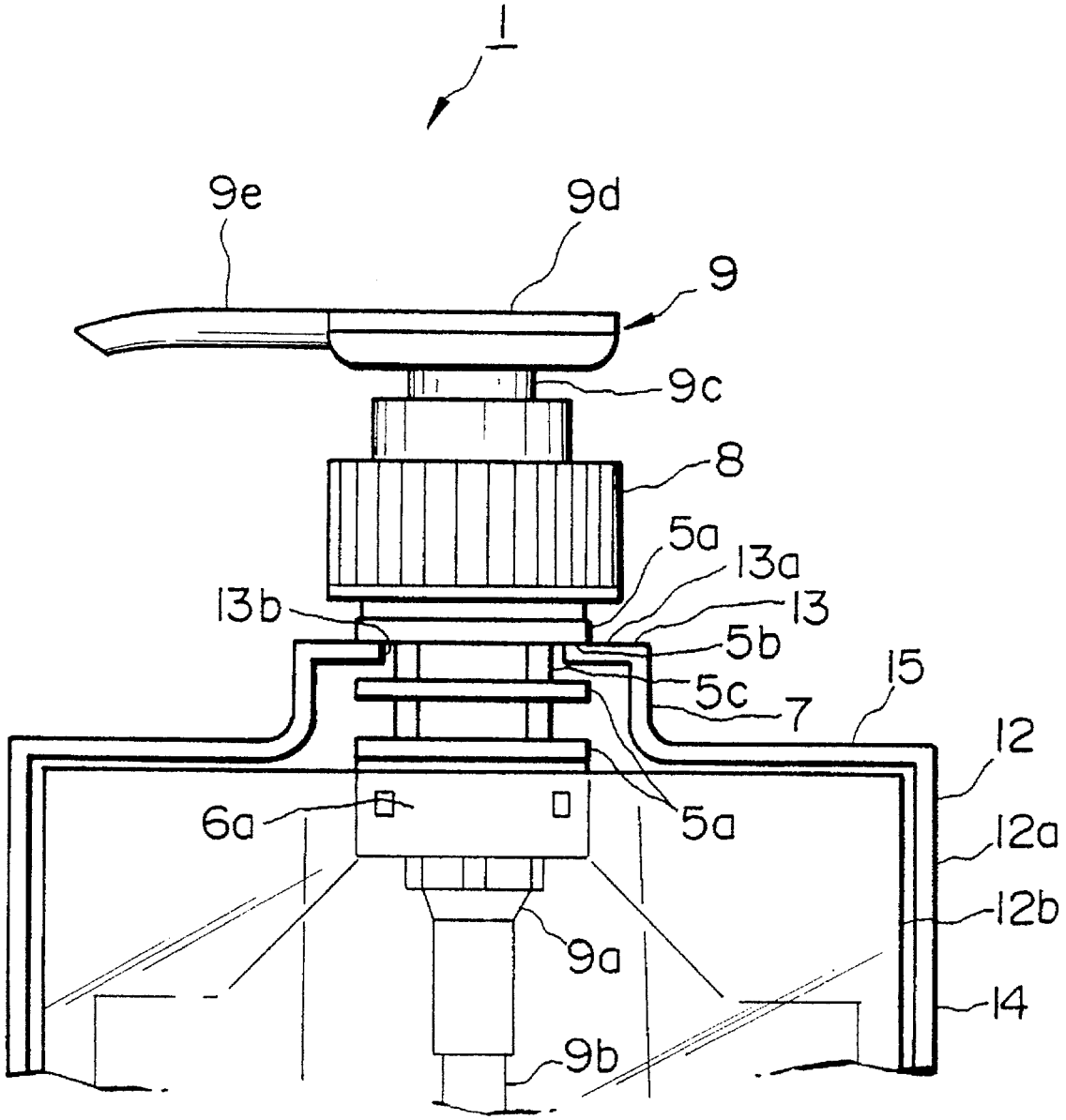
FIG. 3 is a side view illustrative of an outlet block fixed on the box.
Figure 4:
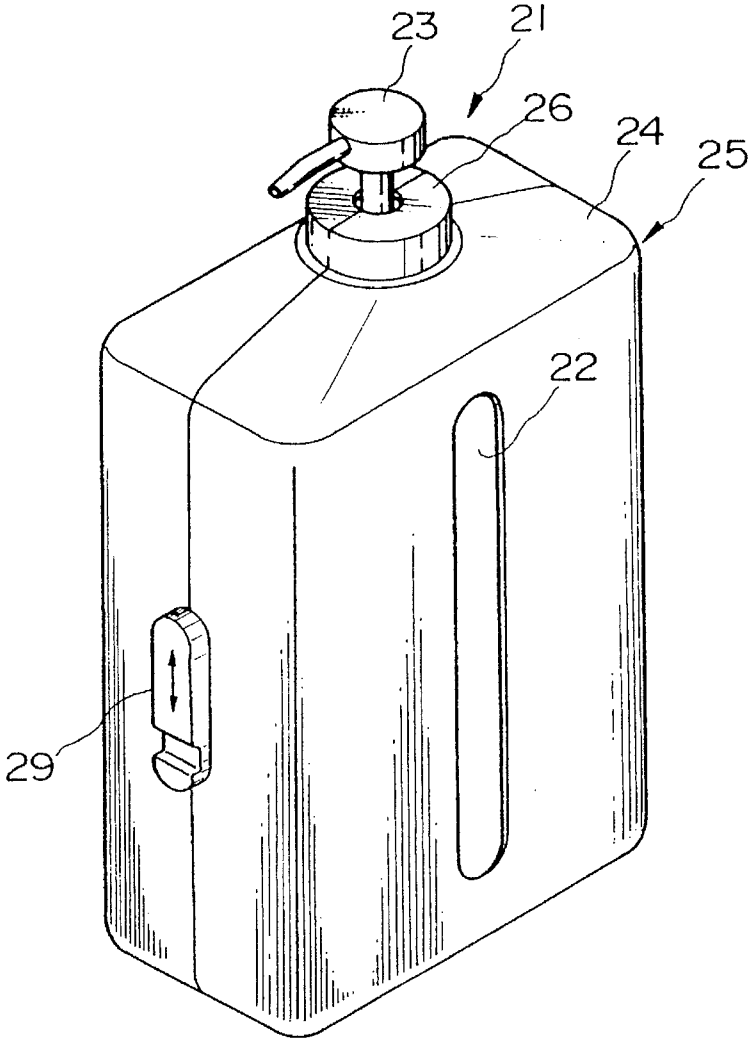
FIG. 4 is a perspective view illustrative of a liquid-pumping container of a conventional type: an external structure of the entire container.
Figure 5:
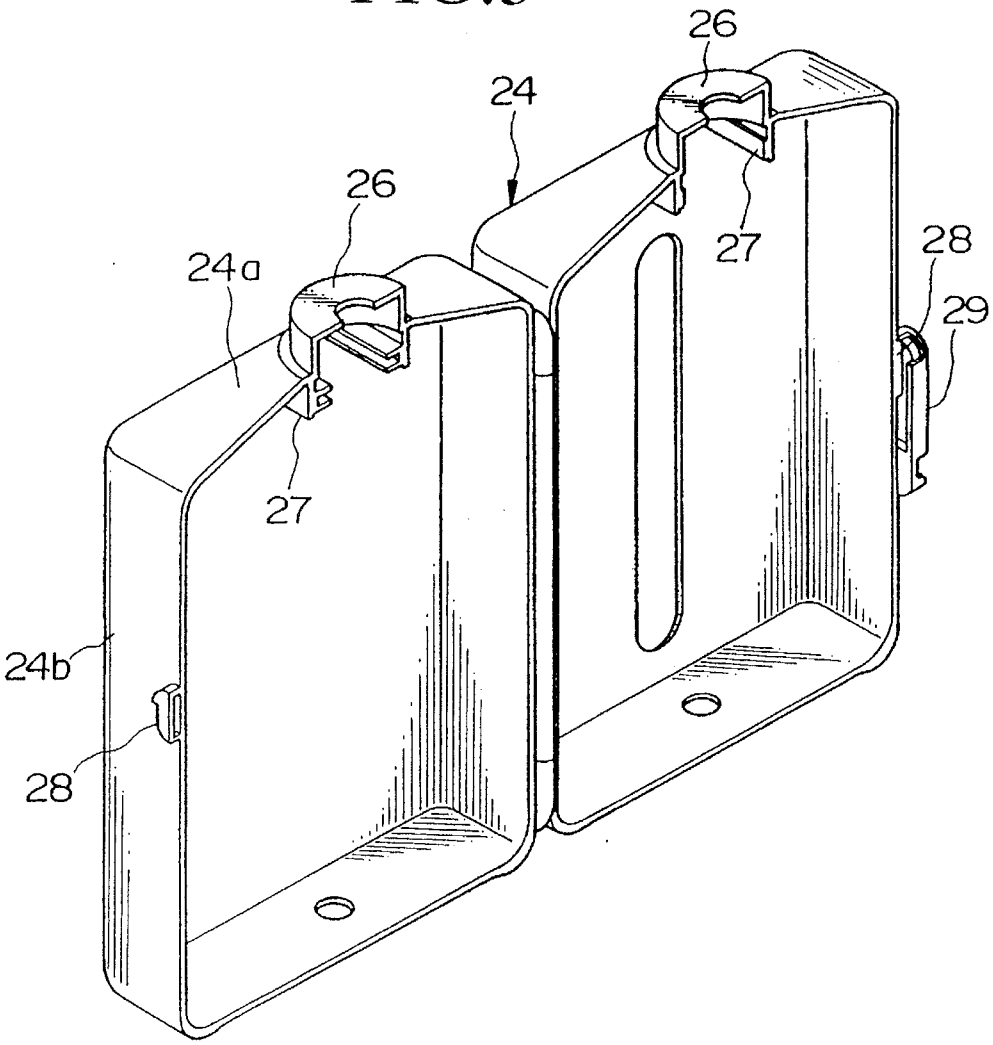
FIG. 5 is a perspective view illustrative of a liquid-pumping container of a conventional type: an external structure of the container when it is open.

FIG. 1 through FIG. 3 illustrate a liquid-pumping container according to an embodiment of this invention. Reference numeral 1 in these figures denotes the liquid-pumping container.

As illustrated in FIG. 2, the liquid-pumping container 1 comprises:

a container 7 consisting of a bag 2 for containing a liquid substance and an outlet block 6 having an outlet hole 3 from the bag 2, a cover block mounting portion 4, and a box fixing portion 5;

a pump mechanism 9 having a cover block 8 which is detachably mounted on the cover mounting portion 4 of the outlet block 6 and used for pumping the liquid substance out of the bag 2 through the cover bock 8 mounted on the cover block mounting portion 4; and a box 11 provided with support block 10 on the top thereof for supporting the outlet block 6 in a predetermined position by fixing the box fixing portion 5 of the outlet block 6, so as to contain the bag 2 inside.

The container 7 illustrated in FIG. 2 comprises: the bag 2 for containing a liquid substance which is made of a transparent, semitransparent, or colored laminated sheet of aluminium and plastics or a polyethylene sheet having a certaing flexibility; and the outlet block 6 which is liquid-tightly provided at the top center of the bag 2.

The outlet block 6 is provided with the outlet hole 3 for outlet of the liquid substance from the bag 2 and a male thread formed on the outer circumference of the outlet block 6. Furthermore, a bag depositing portion 6*a* is formed around an external circumference at the bottom of the outlet block 6 which is inserted into the opening at the top center of the bag 2 so as to provide a liquid-tight connection between the outlet block 6 and the bag 2. The outlet block 6 is also provided with the box fixing portion 5 at an intermediate position in a longitudinal direction of the outlet block so as to be fixed on the support block 10 of the box 11.

The box fixing portion 5 has three horizontal stop shelves 5*a*: an upper stop shelf, an intermediate stop shelf, and a lower stop shelf which are provided in parallel to one another at a predetermined interval. Each of the stop shelves 5*a* is formed into an approximately octagonal shape when viewed from the top (see FIG. 2 and FIG. 3). A groove is determined by the upper and the intermediate stop shelves and a bottom surface 5*c*. The groove is used for fixing a notch 13*a* (see FIG. 2) formed on a ceiling 13 of the support block 10 (which will be described later) so as to prevent horizontal rotation and vertical shifting of the outlet block 6.

As illustrated in FIG. 2, the box 11 which is molded from a single panel is divided into two box components 12 and 12' by a vertical plane which passes through the center of gravity thereof. The box components 12 and 12' are connected to each other through thin hinge sections 14*a* at back walls 14. When the two box components are in a closed position, a space is formed for containing the bag 2. Each of the box components has an opening end which is not flat and is formed so as to be fitted one into the other when the box components are closed.

A rising wall 17 is formed on the top of the box components so as to surround a predetermined length of the box fixing portion 5 of the outlet block 6. The rising wall 17 is provided with a ceiling 13 extending inwardly in a horizontal direction. The ceiling 13 is also divided into two parts provided with a notch 13*a* which form a rectangular hole 13*b* when the two parts are closed. The groove 5*b* on the box fixing portion 5 of the outlet block 6 is fixed with the hole 13*b* in such a manner that the cover block mounting portion 4 is exposed outside of the box components 12 and the cover block 8 having the pump mechanism 9 can be mounted on the cover block mounting portion 4 outside of the box components 12 and 12'. The rising wall 17 and the ceiling 13 are made into a single block, i.e., the support block 10.

As illustrated in FIG. 1 and FIG. 2, on one of the box components 12 is formed a first projection 19*a* which projects upwardly to be fixed with a second projection 19*b* which is formed on the other of the box components and projects downwardly. The first projection 19*a* is locked with and released from the second projection 19*b* by elastically deforming the box components 12 and 12' (see FIG. 1). The first projection 19*a* in combination with the second projection 19*b* functions as a lock mechanism 20.

As illustrated in FIG. 2 and FIG. 3, the pump mechanism 9 comprises:

a cylinder 9*a* fixed on a ceiling of the cover block 8 and extending downward;

a tube 9*b* fixed at the lower end of the cylinder 9*a* and extending almost up to the bottom of the bag 2;

a working tube 9*c* provided on the upper surface of the ceiling of the cover block 8 and connected to the cylinder 9*a;* a push-button 9*d* provided on an upper end of the working tube 9*c;* and an exhaust nozzle 9*e* provided at a front end of the push-button 9*d;* the pump mechanism 9 passing through a cover block 8 having a female thread to be screwed with the male thread 4*a* formed on the outlet block 6.

The pump mechanism 9 is constructed in a manner such that, when mounted on the outlet block 6, pressing of the push-button 9*d* brings about suction of the liquid substance contained in the bag 2*a* from a suction hole (not depicted) provided at a lower end of the tube 9*b* through the tube 9*b* and the cylinder 9*a* so as to push open an exhaust valve (not depicted) provided in a flow path of the working tube 9*c* and to pass out of an outlet (not depicted) of the exhaust nozzle 9*e*.

The liquid-pumping container 1 is constructed as thus far has been described. Description will now be directed to operation of the liquid-pumping container.

In order to place the container 7 in the box 11, the box components 12 are opened and the notch 13*a* provided on the ceiling 13 of the box component 12 is fixed into the groove 5*b* of the box fixing portion 5 of the outlet block 6. After the box component 12' is closed, the first projection 19*a* is fixed with the second projection 19*b* to bring about a locked state. As a result, the hole 13*b* formed by the notch 13*a* is fixed with the groove 12*b* and the outlet block 6 is firmly fixed by the intermediate and the lower stop shelves 5*a* which are provided on the inner surface of the rising wall 17. Thus, the container 7 is contained in an upright position in the box 11.

The tube 9*b* of the pump mechanism 9 is inserted into the outlet hole 3 of the outlet block 6 which extends upward from the support block 10 so as to mount the cover block 8 on the cover block mounting portion 4. Thus, assembly of the container 7, the pump mechanism 9, and the box 11 is complete. In this condition, it is possible to pump the liquid substance out of the liquid-pumping container.

When the liquid substance in the bag 2 is used up, the lock mechanism 20 is released to open the box components 12 and 12'. The container can be taken out of the box block 11 by pulling the outlet block 6 in a horizontal direction from the support block 10. The cover block 8 together with the pump mechanism 9 is removed from the cover block mounting portion 4 and the container 7 which is empty is disposed of. A new container filled with the liquid substance is placed in the box 11 and the cover block 8 together with the pump mechanism 9 is screwed onto the outlet block of the new container.

The liquid-pumping container according to the embodiment of this invention has the following merits. When the container 7 is contained in the box 11, the outlet block 6 is supported by the ceiling 13 provided at the top of the rising wall 17. Thus, a space inside the box block is used more effectively than in the prior art wherein the outlet block is supported by supporting members provided at the bottom of the rising wall. Moreover, the cover block mounting portion 4 of the outlet block 6 is positioned out of the box 11. This makes it possible to mount the cover block 8 having the pump mechanism 9 after placing the container 7 in the box 11. Thus, assembly of the liquid-pumping container and replacement of the container can be easily performed.

The octagonal stop shelves 5*a* of the outlet block 6 are fixed with the inner surface of the rising wall 17 which are made into a corresponding octagonal shape when viewed from above. Thus, horizontal rotation of the outlet block 6 is prevented and, accordingly, rotation of the container 7 is prevented when mounting the cover block 8 having the pump mechanism 9. This makes it easier to mount and remove the cover block 8 having the pump mechanism 9.

Horizontal rotation of the outlet block 6 is also prevented by the notch 13*a* of the ceiling 13 fixed into the groove 5*b* of the box fixing portion 5 of the outlet block 6. The height of the rising wall 17 and the length of the box fixing portion 5 can be decreased to minimize the dead space in the box block 11. This also simplifies the external appearance of the box block 11.

Furthermore, the lock mechanism 20 consists of only two members, i.e., the protrusion 19*a* provided on one of the box components 12 and the protrusion 19*b* provided on the other box component 12'. The small number of the members can lower the cost of the liquid-pumping container.

The hole 13*b* formed by the notch 13*a* of the ceiling 13 and the bottom 5*c* of the corresponding groove 5*b* of the box fixing portion 5 can be made into various shapes such as a triangle or a hexagon, rather than the rectangular shape used in the above-described embodiment, so long as the shape can prevent vertical shifting and horizontal rotation of the outlet block 6. The external shape of the stop shelves 5*a* and the internal shape of the rising wall 17 can also be made into various shapes such as a triangle, a rectangle, or a hexagon, so long as the shape can prevent horizontal rotation of the outlet block 6. The number of the stop shelves is not limited to three as in the above embodiment but may be any number more than one.

What is claimed is:

1. A liquid-pumping container comprising:

a container consisting of a flexible bag for containing a liquid substance and an outlet block provided on the top of said bag and having an outlet hole for outlet of the liquid substance, a cover block mounting portion, and a box fixing portion;

a cover block which is liquid-tightly mounted on the cover block mounting portion of said outlet block;

a pump mechanism provided on the cover block for pumping out the liquid substance from said bag;

a box for containing said bag, consisting of a pair of box components connected through hinges so as to open and close the box components and having a support block for supporting said outlet block at a predetermined position through the box fixing portion of said outlet block; and said support block having a raising wall to surround a predetermined length of said box fixing portion of said outlet block, said support block being formed so as to expose said cover mounting portion above said pair of box components when the box fixing portion of the outlet block is fixed, said cover block being detachably mounted on said cover mounting portion, and said pump mechanism being detachably mounted on said cover block.

2. A liquid-pumping container as claimed in claim 1, wherein said bag is made of a transparent or a semitransparent material.

3. A liquid-pumping container as claimed in claim 1, wherein said cover block is detachably mounted on said cover mounting portion.

4. A liquid-pumping container as claimed in claim 1, wherein said pump mechanism is detachably mounted on said cover block.

5. A liquid-pumping container as claimed in claim 1, wherein said pair of box components being molded unitarily, said pair of box components united by at least one hinge section.

6. A liquid-pumping container as claimed in claim 1, wherein said box fixing portion of said outlet block is provided with stop shelves having a polygonal external end shape which corresponds to the internal shape of said rising wall so as to prevent horizontal rotation of said outlet block.

7. A liquid-pumping container as claimed in claim 2, wherein said rising wall is provided with a ceiling at the top thereof, said ceiling having a notch of a polygonal shape when said box components are closed so as to arrange said box fixing portion of said outlet block which portion is provided with a polygonal groove engageable with said notch.

8. A liquid-pumping container as claimed in one of claims 1, 6 to 7, wherein said hinge sections are formed with a common vertical axis and each of said box components is provided with a lock mechanism member at a free end thereof so as to be engageable so as to hold said box components in a closed state.

9. A liquid-pumping container as claimed in claim 8, wherein said box components are molded as a single object together with the engageable lock mechanism members.

10. A liquid-pumping container as claimed in claim 9, wherein one of said lock mechanism members is a first protrusion which protrudes upward and the other is a second protrusion which protrudes downward.

11. A liquid-pumping container as claimed in claim 10, wherein said first protrusion and said second protrusion are constructed so as to be mutually engageable and releasable from each other by elastically deforming at least one of said pair of box components.

12. A liquid-pumping container as claimed in claim 1, wherein said support block has a shape such that said box fixing portion can be shifted in a horizontal direction for mounting and removing.

13. A liquid-pumping container as claimed in claim 1, wherein said support block has a rising wall to surround a predetermined length of said box fixing portion of said outlet block and is formed so as to expose said cover mounting portion above said pair of box components when the box fixing portion of the outlet block is fixed.

14. A liquid-pumping container as claimed in claim 1, wherein said support block has an internal wall so as to form a polygonal hole when said pair of box components is closed.

15. A liquid-pumping container comprising:

a container consisting of a flexible bag for containing a liquid substance and an outlet block provided on the top of said bag and having an outlet hole for outlet of the liquid substance, a cover block mounting portion, and a box fixing portion;

a cover block which is liquid-tightly mounted on the cover block mounting portion of said outlet block;

a pump mechanism provided on the cover block for pumping out the liquid substance from said bag; and a box for containing said bag, consisting of a pair of box components connected through hinges so as to open and close the box components and having a support block for supporting said outlet block at a predetermined position through the box fixing portion of said outlet block, wherein said hinge sections being formed with a common vertical axis and each of said box components being provided with a lock mechanism member at a free end thereof so as to be engageable so as to hold said box components in a closed state.

16. A liquid-pumping container as claimed in claim 15, wherein said box components are molded as a single object together with the engageable lock mechanism members.

17. A liquid-pumping container as claimed in claim 16, wherein one of said lock mechanism members is a first protrusion which protrudes upward and the other is a second protrusion which protrudes downward.

18. A liquid-pumping container as claimed in claim 17, wherein said first protrusion and said second protrusion are constructed so as to be mutualy engageable and releaseable from each other by elastically deforming at least one of said pair of box components.

19. A liquid-pumping container comprising:

a container consisting of a flexible bag for containing a liquid substance and an outlet block provided on the top of said bag and having an outlet hole for outlet of the liquid substance, a cover block mounting portion, and a box fixing portion;

a cover block which is liquid-tightly mounted on the cover block mounting portion of said outlet block;

a pump mechanism provided on the cover block for pumping out the liquid substance from said bag; and a box for containing said bag, consisting of a pair of box components connected through hinges so as to open and close the box components and having a support block for supporting said outlet block at a predetermined position through the box fixing portion of said outlet block, said support block having an internal wall so as to form a polygonal hole when said pair of box components is closed, wherein said box fixing portion of said outlet block is being provided with stop shelves having a polygonal external end shape which corresponds to the internal shape of said rising wall so as to prevent horizontal rotation of said outlet block.

20. A liquid-pumping container as claimed in claim 19, wherein said rising wall is provided with a ceiling at the top thereof, said ceiling having a notch of a polygonal shape when said box components are closed so as to arrange said box fixing portion of said outlet block which portion is provided with a polygonal groove engageable with said notch.

* * * * *